US006286307B1

(12) United States Patent
Feeny et al.

(10) Patent No.: US 6,286,307 B1
(45) Date of Patent: Sep. 11, 2001

(54) EXHAUST GAS CONTROL DEVICE FOR AN ENGINE

(76) Inventors: Robert L. Feeny, 12578 Cathy St.; John Penley, 14918 Bleeker St., both of Sylmar, CA (US) 91342

( * ) Notice: Subject to any disclaimer, the term of this patent is extended or adjusted under 35 U.S.C. 154(b) by 0 days.

(21) Appl. No.: 09/501,478

(22) Filed: Feb. 9, 2000

(51) Int. Cl.[7] ..... F01N 7/10

(52) U.S. Cl. ..... 60/324; 60/288; 60/292; 123/323; 251/327

(58) Field of Search ..... 60/288, 287, 289, 60/324, 292, 312, 316; 123/323; 251/327, 63

(56) References Cited

U.S. PATENT DOCUMENTS

| | | | | |
|---|---|---|---|---|
| 922,563 | | 5/1909 | Chadwick . | |
| 1,794,642 | | 3/1931 | Radford . | |
| 2,488,563 | | 11/1949 | Sills . | |
| 2,833,479 | | 5/1958 | Novesky . | |
| 2,960,178 | | 11/1960 | De Lorean . | |
| 3,090,677 | | 5/1963 | Scheitlin et al. . | |
| 3,523,418 | | 8/1970 | Marsee . | |
| 3,776,275 | * | 12/1973 | Updike | 137/625.4 |
| 3,805,521 | * | 4/1974 | Dafler et al. | 60/288 |
| 4,054,156 | * | 10/1977 | Benson | 137/630.12 |
| 4,205,704 | * | 6/1980 | Benson | 137/630.12 |
| 4,669,585 | * | 6/1987 | Harris | 188/273 |
| 4,903,802 | * | 2/1990 | Takigawa et al. | 188/273 |
| 4,920,747 | | 5/1990 | Haney . | |
| 5,323,609 | | 6/1994 | Konrath et al. . | |
| 5,401,001 | | 3/1995 | Cook et al. . | |
| 5,452,578 | | 9/1995 | Barber . | |
| 5,743,088 | * | 4/1998 | Grath | 60/324 |
| 6,085,525 | * | 6/2000 | Håkansaon et al. | 60/602 |
| 6,109,027 | * | 8/2000 | Schaefer | 60/324 |

* cited by examiner

*Primary Examiner*—Thomas Denion
*Assistant Examiner*—Binh Tran
(74) *Attorney, Agent, or Firm*—Jones, Day, Reavis & Pogue

(57) ABSTRACT

An improved exhaust gas control device that has a hollow diverter pipe to divert exhaust around the muffler and in which a gate valve is slidably mounted to open and close the hollow pipe thus either forcing the exhaust gas through the muffler or diverting it to the atmosphere.

5 Claims, 2 Drawing Sheets

EXHAUST GAS CONTROL DEVICE FOR AN ENGINE

BACKGROUND OF THE INVENTION

1. Field of the Invention

The invention relates generally to exhaust systems for internal combustion engines and in particular to an improved exhaust gas control device that can selectively conduct the exhaust gases to a muffler or directly to the atmosphere as desired.

2. Description of Related Art Including Information Disclosed Under 37 CFR 1.97 And 1.98

Muffler systems are well known in the art and are placed on internal combustion engines to enable the engines to run more quietly. However, it is also well known that such systems create back pressure that lessens the efficiency of the engine.

Consequently, many devices have been developed to selectively divert such exhaust gases from the muffler directly to the atmosphere. This allows the engine to operate more efficiently but does increase the noise of the engine.

Such devices in the prior art have always used flapper valves or butterfly valves. For instance, in U.S. Pat. No. 5,452,578, a housing is placed in the exhaust manifold with a diverter plate or flapper valve that, in a first position, lies flat below the exhaust pipe but, when activated, pivots at the base upwardly to divert the incoming exhaust gases outwardly to the atmosphere. Because of the construction of such valve, there is leakage around it and consequently the greatest efficiency is not obtained.

Further, in U.S. Pat. No. 5,401,001, the exhaust control valve is in the form of a butterfly valve that, when vertical, causes the exhaust gases to flow in one path and, when horizontal, allows exhaust gas to flow through a second path. This device is sealed by a complex arrangement of several parts to event escape of exhaust gases.

It would be desirable to have an exhaust control valve that seals off one path to prevent exhaust gases from escaping or alternatively to open a second path and allow them to escape. Such a device can be provided with the use of a gate valve rather than a flapper valve or butterfly valve.

SUMMARY OF THE INVENTION

The present invention overcomes the disadvantages of the prior art by providing a gate valve as the operating valve in the exhaust control device. A gate valve is one that slides into a groove in the interior of the exhaust pipe in a direction perpendicular to the longitudinal axis of the exhaust pipe to close it off tightly and slides out of the groove when the valve is opened. Thus, an exhaust gas collector pipe extends from an exhaust manifold of an engine to a muffler. A hollow pipe having an input end is fixedly mounted to the collector pipe between the exhaust manifold and the muffler to selectively receive exhaust gases from the collector pipe. It also has an output end that is opened to the atmosphere. A slidably mounted gate valve is provided in the hollow pipe and has a first closed position forcing the flow of exhaust gases through the exhaust manifold. It has a second open position allowing the flow of exhaust gases through the hollow pipe directly to the atmosphere. The slidable mounted gate valve may be operated by a fluid control cylinder such as a hydraulic cylinder or an air cylinder or may be operated electrically by a solenoid-type cylinder. A control can be mounted in the interior of the vehicle to allow the operator to selectively open or close the slidable gate valve to either force the exhaust gases to pass through the muffler or allow them to be diverted around the muffler.

Thus, the present invention relates to an improved exhaust gas control device that utilizes a slidably mounted gate valve as the exhaust control valve.

It is another object of the present invention to use a slidably mounted gate valve in the form of a substantially flat circular plate that slides into and out of the hollow pipe by following an annular recess on the inside surface of the hollow pipe.

It is also an object of the present invention to provide an actuator cylinder controllable from the vehicle interior to selectively slide the gate valve between its first and second positions.

It is yet another object of the present invention to activate the gate valve between its first and second positions with an actuator cylinder that is either a fluid operating cylinder such as hydraulic or air operated, or an electric actuator such as a solenoid.

It is still another object of the present invention to provide a slidable gate valve in the form of a wedge-shaped plug.

It is also an object of the present invention to provide an exhaust control device having a gate valve slidable between first and second positions and formed of a wedge-shaped plate.

Thus the invention relates to an improved exhaust control device for an engine having an exhaust gas collector pipe extending from an exhaust manifold to a muffler comprising a hollow pipe having an input end fixedly mounted to the exhaust gas collector pipe between the exhaust manifold and the muffler to receive exhaust gasses from the collector pipe and an output opened to the atmosphere. A slidably mounted gate valve in the hollow pipe has a first closed position directing the flow of exhaust gases through the exhaust manifold to the exhaust muffler and a second open position allowing a flow of exhaust gas through the hollow pipe directly to the atmosphere. An operating mechanism such as a fluid-type piston or an electrically operated solenoid-type piston is coupled to the slidably mounted gate valve to selectively move the gate valve between the first and second positions.

BRIEF DESCRIPTION OF THE DRAWINGS

These and other objects of the present invention will be more fully disclosed when taken in conjunction with the following Detailed Description of the Drawings in which like numerals represent like elements and in which.

DETAILED DESCRIPTION OF THE DRAWINGS

Figure 1:
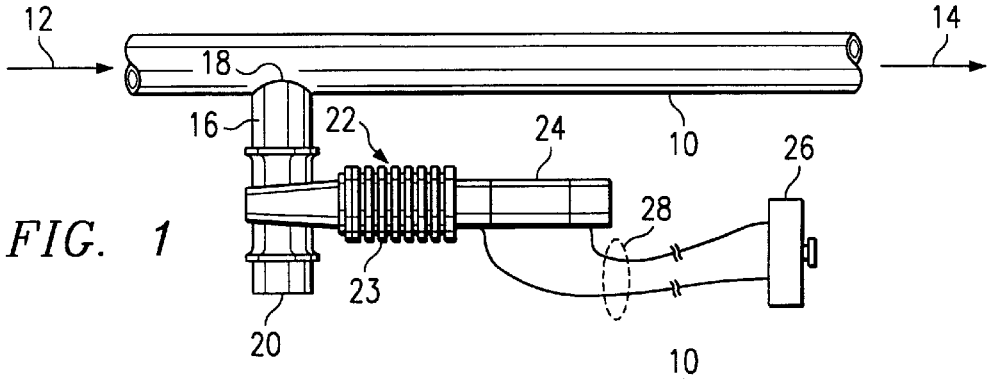
FIG. 1 is a partial schematic view of a gas exhaust system having the novel exhaust gas control device attached thereto.

In FIG. 1 a partial schematic of an exhaust control system is illustrated with the exhaust pipe 10 receiving exhaust gases from the manifold at 12 and coupling them to the muffler at 14. The novel exhaust control device of the present invention has a hollow pipe 16 attached at a front end 18 to the exhaust pipe 10 in a well-known manner such as by welding. The pipe 16 has an outer end 20 that is opened to the atmosphere. A novel exhaust control valve 22 is attached to pipe 16 with an adapter 23 as will be shown in greater detail hereafter. A gate valve operating device 24, such a fluid cylinder or a solenoid, is coupled through adapter 23 to the gate valve to move it from a first position closing pipe 16 and forcing the exhaust gases to the muffler 14 and a second position which opens pipe 16 and allows the exhaust gas to exit to the atmosphere at 20.

Appropriate control lines 28, whether fluid such as air, or hydraulic or electricity for a solenoid, are coupled to a control actuator 26 in the vehicle so that the operator thereof can selectively open and close the gate valve with the use of the novel exhaust gas control device 22.

Figure 2:
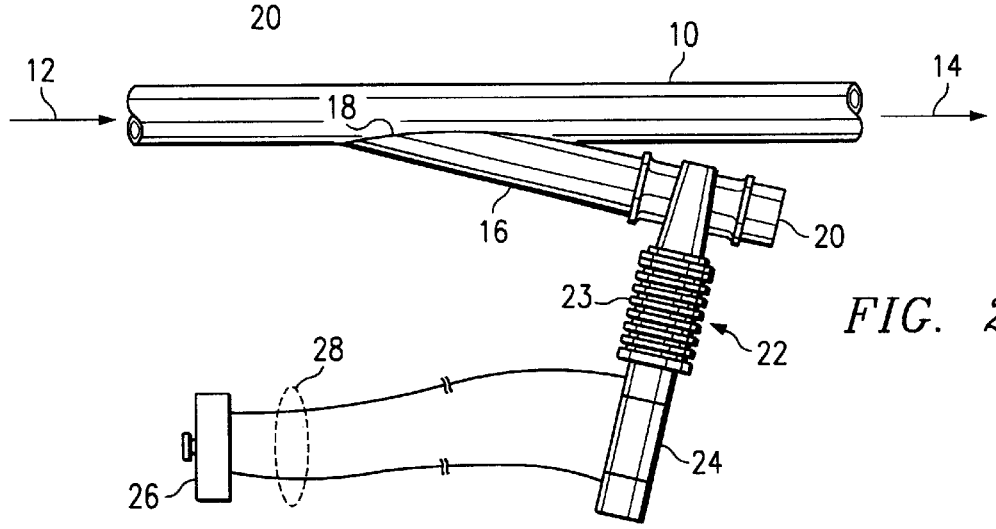
FIG. 2 is a partial schematic representation of a second embodiment of an exhaust gas system for having the novel control valve attached thereto.

FIG. 2 is a second embodiment illustrating that the pipe 16 is attached to the exhaust pipe 10 at an angle. Otherwise, the control device 23 functions in the same manner as disclosed previously. The fluid connections 28, or electrical connections 28, are old and well known in the art and need not be described here.

Figure 3:
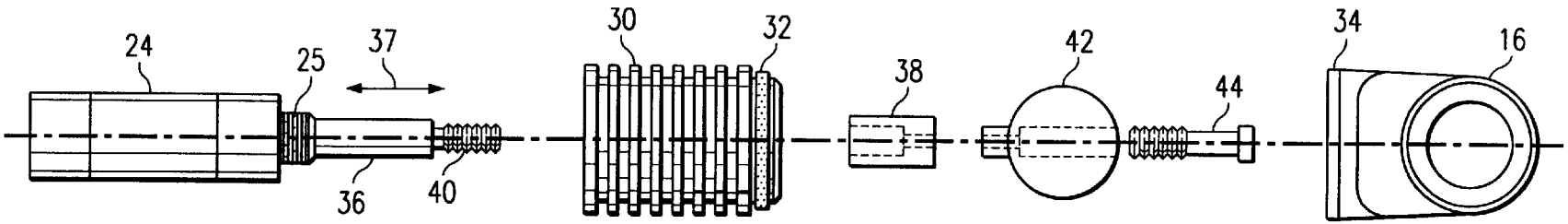
FIG. 3 is an exploded side view of the novel exhaust gas control valve of the present invention when a circular flat plat gate valve is utilized.

FIG. 3 is a top exploded view of the novel gas control device 22. Hollow pipe 16 is cylindrical in shape as can be seen and has a threaded flange 34 that can be connected to adaptor 30 with threads 32 as will be shown in FIGS. 5 and 6.

The actuating cylinder 24 has a movable shaft 36 that can move in forward and reverse directions as illustrated by arrow 37. It has threads 40 that can be threadedly attached to connector 38 that has internal threads seen in phantom lines. The gate valve 42 is shown in side view and is circular in shape from the side. It has a hollow interior and bolt 44 may be inserted therethrough and threadedly attached to the other end of connector 38, thus connecting the gate valve 42 to the piston 36 of actuator 24.

Figure 4:
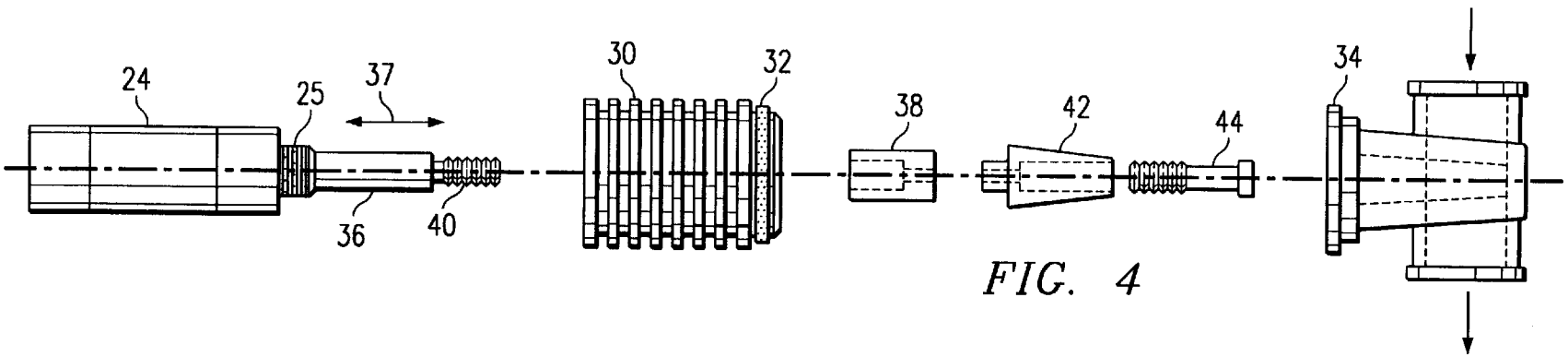
FIG. 4 is an exploded top view of the embodiment of the novel gate valve shown in FIG. 3.

FIG. 4 is the top view of the exploded novel exhaust valve control device 22 illustrating that the gate valve 42 can be wedge-shaped in order to provide a tight seal within housing 16.

Figure 5:
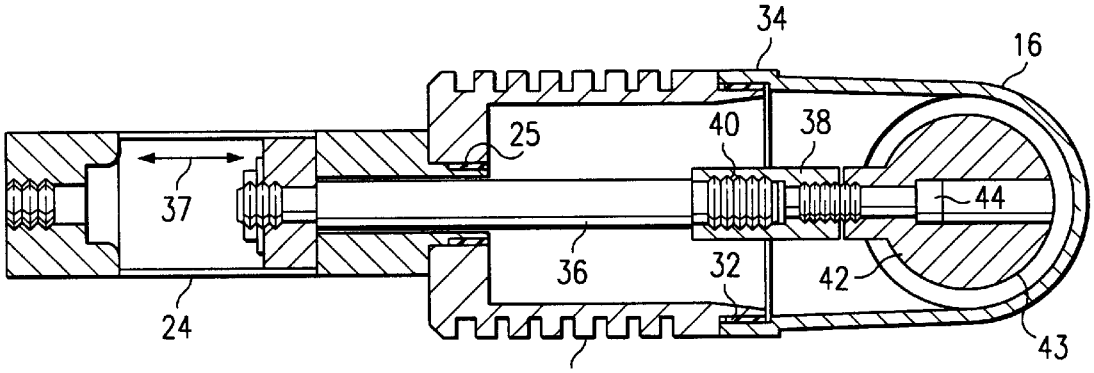
FIG. 5 is a cross-sectional view of the novel exhaust gas control valve utilizing a circular gate valve with the valve in its closed position.

FIG. 5 is a cross-sectional view of the novel exhaust valve control device with the gate valve 42 in the closed position, closing off pipe 16 and forcing the exhaust gases to the muffler 14 as illustrated in FIGS. 1 and 2. While the cylinder 24 is illustrated as a fluid cylinder, it can obviously be an electrical solenoid of any well-known type.

Figure 6:
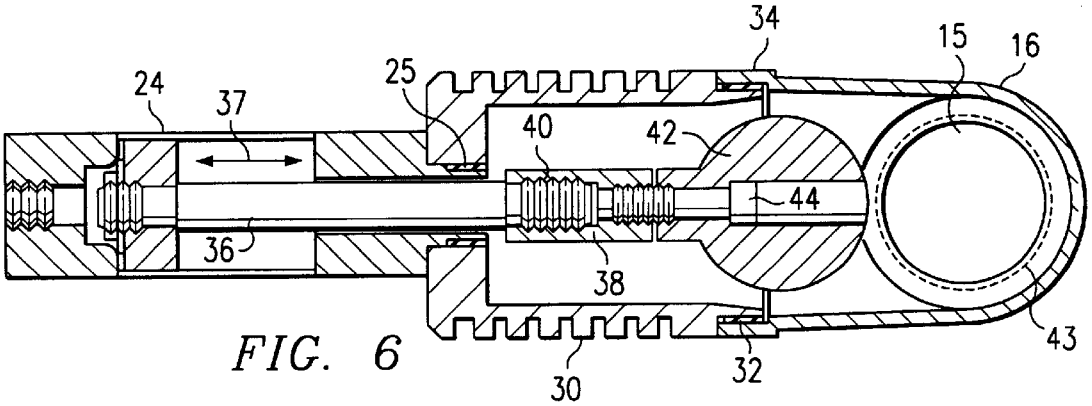
FIG. 6 is a cross-sectional view of the gate valve in FIG. 5 in the open position.

FIG. 6 illustrates the novel exhaust gas control device with the gate valve in the open position, thus allowing the exhaust gases to flow through the interior 15 of exhaust pipe 16 to the atmosphere as illustrated in FIGS. 1 and 2.

It will be seen in both FIGS. 5 and 6 that a recess 43 is formed on the interior surface of pipe 16 and in which the gate valve 42 can slide to seal off any flow of exhaust gases to the interior 15 of exhaust pipe 16 when the gate valve is in the closed position shown in FIG. 5.

Thus, there has been disclosed a novel exhaust valve control device formed with a gate valve that is not only simple to construct and to operate but which efficiently seals off the exhaust pipe to the atmosphere when it is in the closed position, thus diverting all of the exhaust gases through the muffler. In like manner, it also opens the exhaust pipe to the atmosphere in the open position, thus diverting all of the exhaust gases to atmosphere in the open position.

The corresponding structures, materials, acts, and equivalents of all means or step plus function elements in the claims below are intended to include any structure, material, or act for performing the function in combination with other claimed elements as specifically claimed.

What is claimed is:

1. An improved exhaust gas control device (22) for an engine having an exhaust gas collector pipe (10) extending from an exhaust manifold (12) to a muffler (14) comprising:

a hollow pipe (16) having an input end (18) fixedly mounted to said collector pipe (10) between said exhaust manifold (12) and said muffler (14) to receive exhaust gases from said collector pipe (10) and an output end (20) opened to the atmosphere;

a slidably mounted gate valve in said hollow pipe having a first closed position directing the flow of exhaust gas through said exhaust gas collector pipe to said muffler and a second open position allowing the flow of exhaust gases directly to atmosphere;

an operating mechanism (24) coupled to said slidable gate valve (42) to selectively move said gate valve (42) between said first closed position and second open position;

a housing extending from, and forming a part of, said hollow pipe, said hollow pipe being cylindrical in cross section with an inside surface;

an annular recess on the inside surface of said hollow pipe; and a circular plate slidably mounted in said housing and forming said gate valve for mating with said annular recess in said first position to close the output end of said hollow pipe and direct said exhaust gases through said muffler when said gate valve is in said first position.

2. The improved exhaust gas control device of claim 1 further comprising:

a hollow adapter connected to said housing in fluid-tight relationship;

an actuator cylinder attached to said hollow adapter; and an arm actuated by said actuator cylinder and connected to said gate valve to selectively move said gate valve between said first and second positions.

3. The improved exhaust gas control device as in claim 2 further including a fluid operating cylinder as said actuator cylinder.

4. The improved exhaust gas control device of claim 2 further including an electrically operated solenoid as said actuator cylinder.

5. The improved exhaust gas control device of claim 1 wherein said circular plate forming said gate valve is wedge-shaped in cross section.

* * * * *